US012492822B2

(12) United States Patent
Beepath et al.

(10) Patent No.: US 12,492,822 B2
(45) Date of Patent: Dec. 9, 2025

(54) PATIO HEATER WITH REFLECTIVE FINS

(71) Applicant: CANADIAN TIRE CORPORATION, LIMITED, Toronto (CA)

(72) Inventors: Kevin Beepath, London (CA); Adam Smith, Toronto (CA); Joran Van Lang, Toronto (CA); Jim Scott, Cambridge (CA)

(73) Assignee: CANADIAN TIRE CORPORATION, LIMITED, Toronto (CA)

( * ) Notice: Subject to any disclaimer, the term of this patent is extended or adjusted under 35 U.S.C. 154(b) by 398 days.

(21) Appl. No.: 18/061,678

(22) Filed: Dec. 5, 2022

(65) Prior Publication Data

US 2023/0175698 A1 Jun. 8, 2023

Related U.S. Application Data

(60) Provisional application No. 63/286,225, filed on Dec. 6, 2021.

(51) Int. Cl.

| | |
|---|---|
| ***F24C 3/04*** | (2021.01) |
| ***F23D 14/06*** | (2006.01) |
| ***F24C 15/22*** | (2006.01) |

(52) U.S. Cl.

CPC ..... *F24C 3/042* (2013.01); *F24C 15/22* (2013.01); *F23D 14/06* (2013.01)

(58) Field of Classification Search

CPC .... F24C 15/22; F24C 1/10; F24C 1/12; F24C 3/042; F23D 14/06

USPC ..... 126/92 B, 83, 92 R, 96, 92 AC; 431/326–329

See application file for complete search history.

(56) References Cited

U.S. PATENT DOCUMENTS

| | | | | |
|---|---|---|---|---|
| 2,516,285 | A * | 7/1950 | Winkler | F24C 15/22 D23/336 |
| 2,700,970 | A * | 2/1955 | Cartter | F24C 15/22 126/91 R |
| 6,745,759 | B2 | 6/2004 | Bossler | |
| 7,278,418 | B2 | 10/2007 | Duphily et al. | |
| 9,149,097 | B1 | 10/2015 | Davis | |
| 10,222,068 | B2 | 3/2019 | Bechtold | |
| 2005/0175950 | A1 * | 8/2005 | Waters | F24C 1/12 432/209 |
| 2011/0073095 | A1 | 3/2011 | Bechtold | |
| 2013/0167835 | A1 | 7/2013 | Zhu | |

* cited by examiner

*Primary Examiner* — Vivek K Shirsat

(74) *Attorney, Agent, or Firm* — Norton Rose Fulbright Canada LLP

(57) ABSTRACT

A patio heater, has: a base to be supported on a ground; a stem protruding upwardly away from the base; and a heat generating device secured to the stem, the heat generating device having: a burner fluidly connected to a source of a fuel to be burned; a diffusion sheet enclosing a combustion chamber, the burner located inside the combustion chamber and surrounded by the diffusion sheet; a reflective shield located above the diffusion sheet; and at least one reflective fin mounted to the diffusion sheet and extending away therefrom.

19 Claims, 5 Drawing Sheets

PATIO HEATER WITH REFLECTIVE FINS

CROSS-REFERENCE TO RELATED APPLICATIONS

This application claims benefit from U.S. provisional application No. 63/286,225 filed on Dec. 6, 2021, the entire contents of which are incorporated herein by reference.

TECHNICAL FIELD

This disclosure generally relates to the field of outdoor heating devices and, more particularly, to patio heaters.

BACKGROUND

Patio heaters typically use a burner located in a combustion chamber for burning a gas, such as propane. A reflector or heat shield is provided above the combustion chamber and is shaped as an umbrella. The purpose of the reflector is to redirect radiative heat in a downward direction towards people gathering in a vicinity of the patio heater. However, substantial heat losses occur by convection between the reflector and the surrounding environment. Improvements are therefore sought.

SUMMARY

In one aspect, there is provided a patio heater, comprising: a base to be supported on a ground; a stem protruding upwardly away from the base; and a heat generating device secured to the stem, the heat generating device having: a burner fluidly connected to a source of a fuel to be burned; a diffusion sheet enclosing a combustion chamber, the burner located inside the combustion chamber and surrounded by the diffusion sheet; a reflective shield located above the diffusion sheet; and at least one reflective fin mounted to the diffusion sheet and extending away therefrom.

The patio heater described above may include any of the following features, in any combinations.

In some embodiments, the at least one reflective fin includes two reflective fins disposed above one another.

In some embodiments, an annular cavity is defined axially between the two reflective fins and radially from the diffuser sheet towards outer edges of the two reflective fins.

In some embodiments, each of the at least one reflective fin extends annularly all around the combustion chamber.

In some embodiments, the at least one reflective fin has a peripheral inner edge and a peripheral outer edge located radially outwardly from the peripheral inner edge relative to a central axis of the heater, the peripheral inner edge being in thermal exchange contact with the diffusion sheet.

In some embodiments, the burner is annular.

In some embodiments, the burner defines apertures circumferentially distributed about a central axis of the patio heater, the apertures extending through a wall of the burner about aperture axes, the aperture axes extending along a direction having a component in a radial direction relative to the central axis.

In some embodiments, each of the at least one reflective fin is located above the burner.

In some embodiments, the reflective shield extends radially beyond a peripheral outer edge of the at least one reflective fin.

In some embodiments, the at least one reflective fin extends downwardly toward the base.

In some embodiments, the reflective shield is made of a material including aluminum.

In some embodiments, the at least one reflective fin is made of a material including stainless steel.

In some embodiments, an angle defined between the at least one reflective fin and the diffuser sheet ranges from 30 to 40 degrees.

In another aspect, there is provided a method of operating a patio heater, comprising: generating combustion gases; heating a diffusion sheet with the combustion gases; reflecting heat of the diffusion sheet downwardly with a reflective shield located above the diffusion sheet; and further reflecting the heat of the diffusion sheet downwardly with at least one reflective fin mounted to the diffusion sheet.

The method described above may include any of the following features, in any combinations.

In some embodiments, the heating of the diffusion sheet with the combustion gases includes impinging the combustion gases against the diffusion sheet.

In some embodiments, the impinging of the combustion gases against the diffusion sheet includes directing the combustion gases through apertures defined through a wall of a burner, the apertures having aperture axes extending along a direction having a component in a radial direction relative to a central axis of the patio heater.

In some embodiments, the further reflecting the heat of the diffusion sheet downwardly with at least one reflective fin mounted to the diffusion sheet includes reflecting heat downwardly with two reflective fins disposed above one another.

In some embodiments, the method includes heating a volume of air contained within a cavity defined between the two reflective fins.

In some embodiments, the reflecting of the heat with the reflective shield includes reflecting the heat with the reflective shield extending radially outwardly beyond outer edges of the diffusion sheet.

In some embodiments, the method includes conductively transferring heat from the diffusion sheet to the at least one fin.

Many further features and combinations thereof concerning the present improvements will appear to those skilled in the art following a reading of the instant disclosure.

BRIEF DESCRIPTION OF THE DRAWINGS

Reference is now made to the accompanying figures in which.

It will be noted that throughout the appended drawings, like features are identified by like reference numerals.

DETAILED DESCRIPTION

Figure 1:
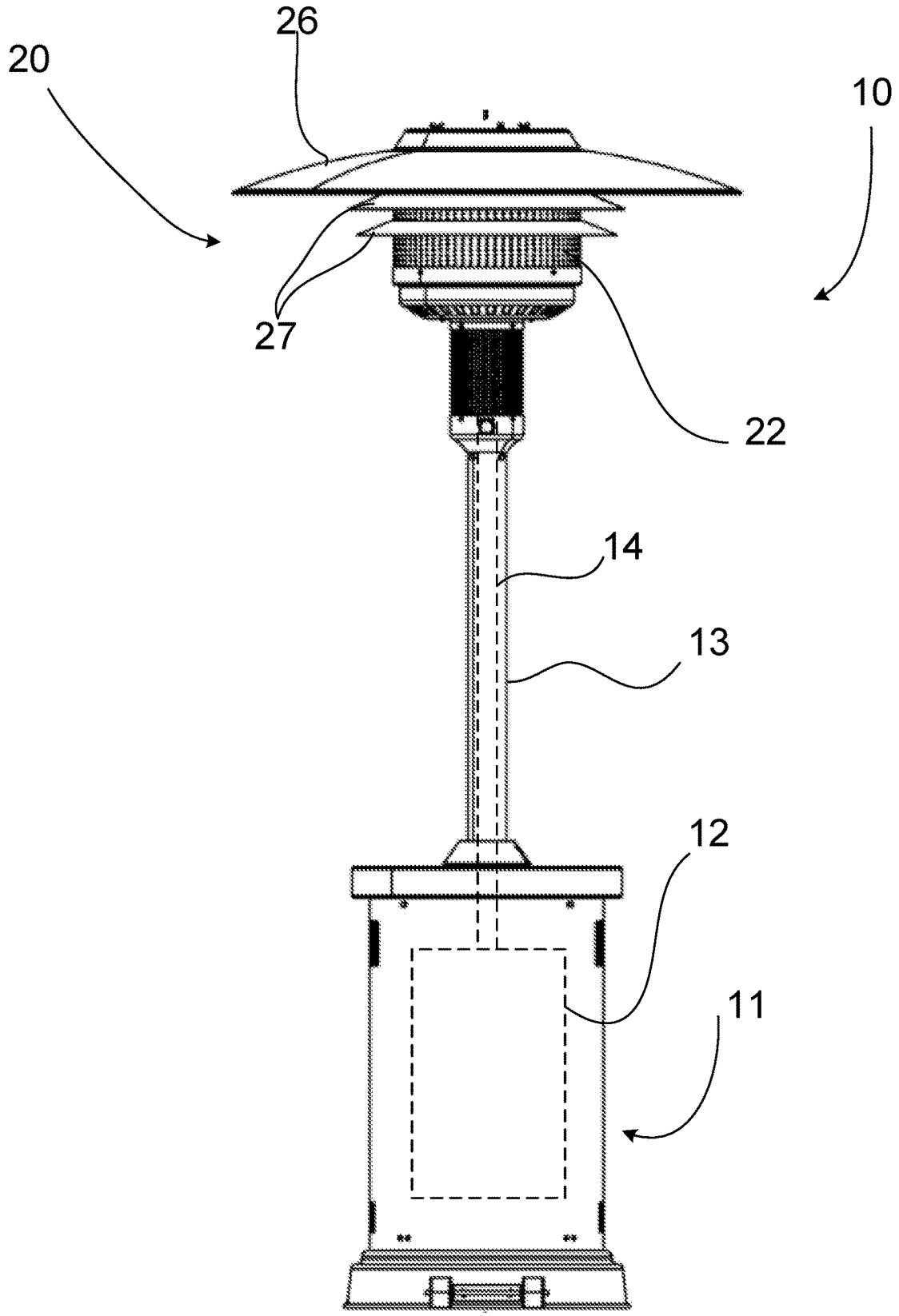
FIG. 1 is a front view of a patio heater in accordance with one embodiment.

Referring now to FIG. 1, a patio heater, referred to simply as heater herein below, is shown at 10. The heater 10 includes a base 11 to be supported on the ground. The base 11 may define an enclosure for storing a reservoir 12 containing a fuel, such as propane or natural gas or any other suitable fuel. A stem 13 protrudes from the base 11 and away from the ground. The stem 13 may enclose a conduit 14 that is fluidly connected to the reservoir 12 of the fuel. A heat generating device 20 is secured to an end of the stem 13. The heat generating device 20 may be operatively connected to the reservoir 12 via the conduit 14. The heat generating device 20 is operable to burn the fuel to generate heat as will be explained below.

Figure 2:
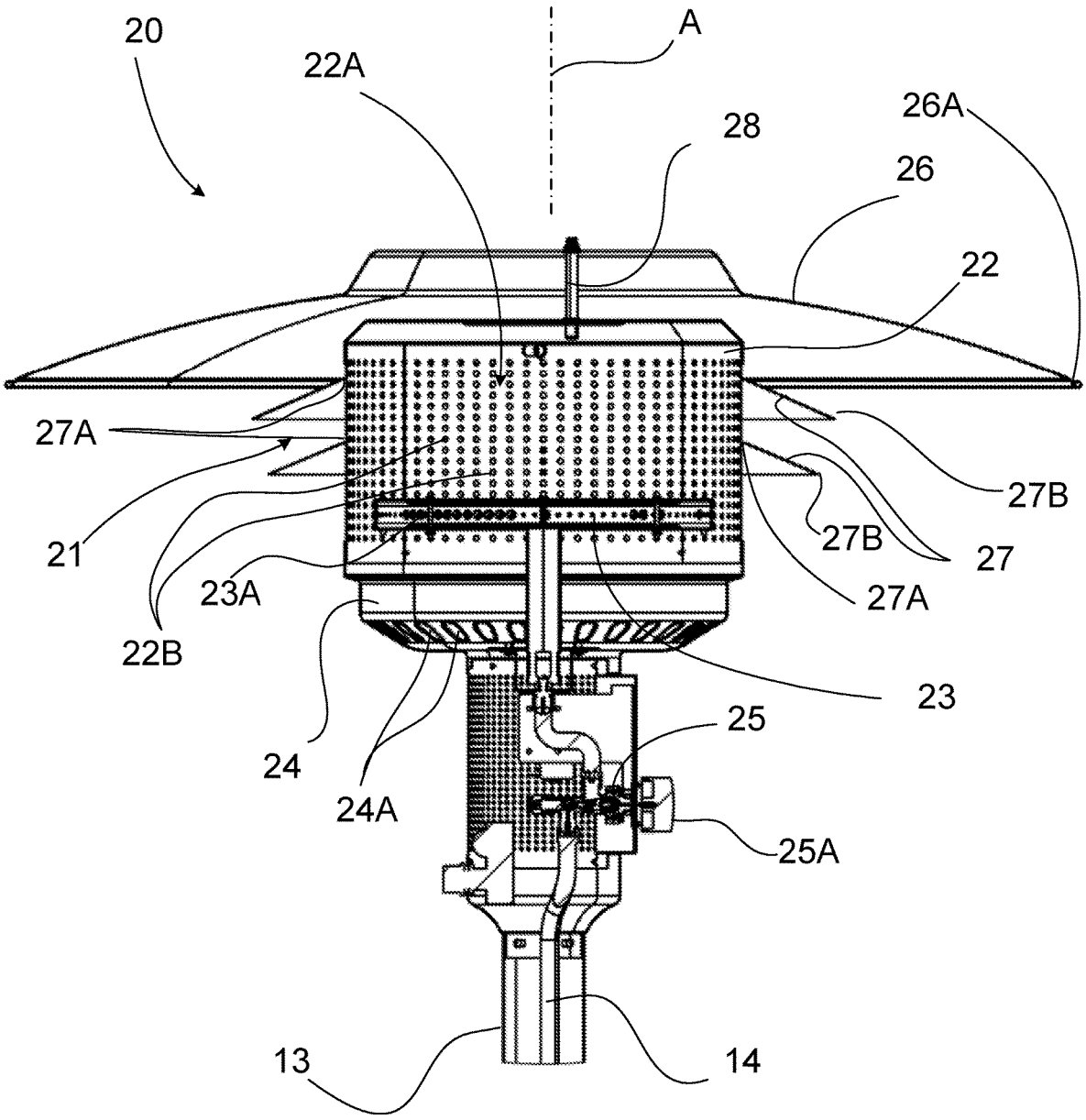
FIG. 2 is a cutaway front view of a heat generating device of the patio heater of FIG. 1.

Referring to FIG. 2, the heat generating device 20 includes a combustor 21 into which the fuel is burned and diffused. The combustor 21 includes a diffusion sheet 22 extending circumferentially around a central axis A of the heater 10. The diffusion sheet 22 encloses a combustion chamber 22A that contains a burner 23. The diffusion sheet 22 defines apertures 22B that are used to allow combustion gases to exit the combustion chamber 22A. A number, size, and shape of these apertures may vary. The diffusion sheet 22 is secured to the stem 13 via a bottom member 24 that extends annularly around the central axis A. The bottom member 24 may have a frustoconical shape, although other shapes are contemplated. The bottom member 24 defines apertures 24A that provide air inlets to the combustion chamber 22A. The apertures 24A are circumferentially distributed around the central axis A and are facing a direction being at least axial relative to the central axis A. In the present case, the apertures 24A are oriented away from the central axis A and toward the ground. Air may therefore enter the combustion chamber 22A from the bottom of the heat generating device 20. The air may enter the combustion chamber 22A in a substantially vertically upward direction. In the context of the present disclosure, the expression "substantially" is meant to encompass slight variations. In other words, a substantially vertical direction may include a component in a circumferential and/or radial direction relative to the central axis A. This component may account for about 10% of the direction.

Figure 3:
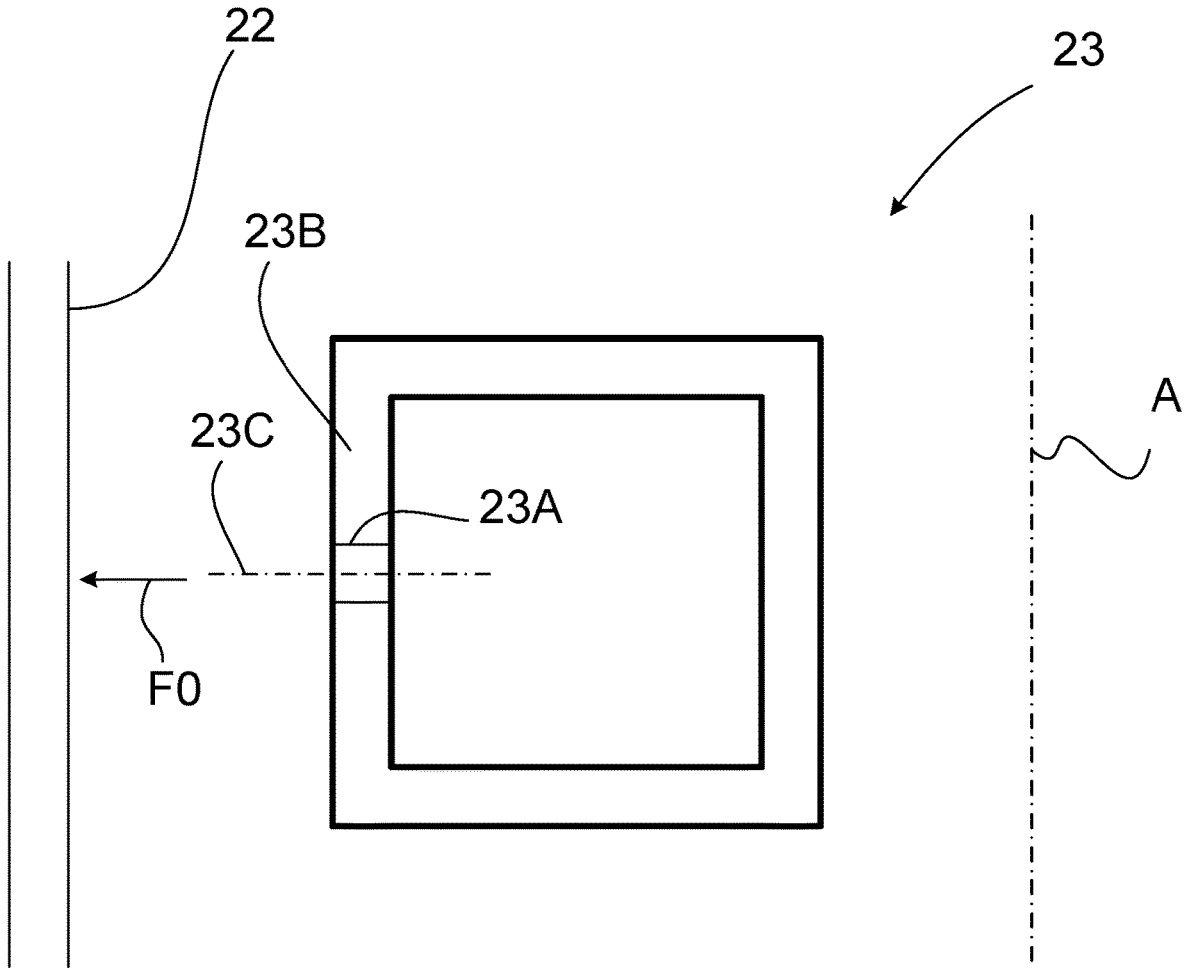
FIG. 3 is a cross-sectional view of a portion of a burner of the patio heater of FIG. 1.

Referring to FIGS. 2-3, in the embodiment shown, the burner 23 is annular and extends circumferentially around the central axis A of the heater 10. The burner 23 may thus be seen as a ring. It may be a single monolithic ring or it may include a plurality of ring segments circumferentially distributed about the central axis A. Any suitable burner may be used. The burner 23 defines a plurality of apertures 23A that are circumferentially distributed around the central axis A. These apertures 23A may define exit flow axes oriented radially outwardly such that flames outputted by the burner 23 are oriented away from the central axis A and toward the diffusion sheet 22. In other words, the apertures 23A may be defined through a wall 23B of the burner 23, the wall 23B facing a direction being mainly (e.g., more than 50%) radial relative to the central axis A, and away from the central axis A. The apertures 23A may therefore extend about aperture axes 23C extending through a thickness of the wall 23B. These aperture axes 23C extending along a direction have a component in the radial direction relative to the central axis A. In the embodiment shown, the aperture axes 23C extend solely radially. In some embodiments, some apertures are oriented such that flames extend toward the central axis A from the burner 23. In the embodiment shown, the burner 23 is axially aligned with some of the apertures 22B of the diffusion sheet 22. This may allow flames from the burner 23 to heat the diffusion sheet 22 and create an infrared effect. Put differently, a flow of combustion gases F0 may therefore exit the burner 23 to impinge on the diffuser sheet 22. The flames exiting the apertures 23A of the burner 23 may impinge on the diffusion sheet 22 to heat the diffusion sheet 22. In the embodiment shown, a radial distance relative to the central axis A between the burner 23 and the diffusion sheet 22 is selected to create an infrared effect and maximize a temperature of the diffusion sheet 22. A radial distance between the diffusion sheet 22 and the burner 23 may range from 10 mm to 20 mm.

Referring back to FIG. 2, a valve 25 may be connected to the conduit 14 and may be used to control a flow rate of the fuel flowing from the reservoir 12 to the burner 23. The valve 25 may be equipped with a handle 25A to be operated by a user of the heater 10. Any suitable type of valve, such as a ball valve, may be used. The valve 25 may therefore be considered as a regulating device for controlling an amount of heat generated by the heater 10. The valve 25 may be manually controlled, or may be controlled via a thermostat, for instance.

Still referring to FIG. 2, the heat generating device 20 further includes a reflective shield 26 located above the diffusion sheet 22. The reflective shield 26 may be secured to the diffusion sheet 22 via any suitable fasteners 28. The reflective shield 26 includes an outer edge 26A that is located radially beyond the diffusion sheet 22 relative to the central axis 11. Put differently, the outer edge 26A of the reflective shield 26 extends radially outwardly away form the central axis A beyond the diffusion sheet 22. The reflective shield 26 may thus cover the diffusion sheet 22. The reflective shield 26 defines a concavity facing toward the combustion chamber 21 to reflect radiative heat generated by the combustor 21 toward the base 11 and toward users located underneath the reflective shield 26. The reflective shield 26 may be made of aluminum or any other suitable material such as stainless steel.

In the embodiment shown, the heat generating device 20 includes two reflective fins 27 disposed above one another. The reflective fins 27 are axially offset from one another relative to the central axis A. The reflective fins 27 may be made of any suitable material such as stainless steel. The reflective fins 27 may extend annularly a full circumference around the central axis A. In some cases, the reflective fins 27 may include a plurality of fin sections each covering a portion of the circumference of the diffusing sheet 22. In some embodiments, only one or more than two reflective fin(s) 27 may be used. The reflective fins 27 have peripheral inner edges 27A and peripheral outer edges 27B located radially outwardly of the peripheral inner edges 27A relative to the central axis A. The peripheral inner edges 27A may be directly secured to the diffusion sheet 22 (e.g., fastened, welded, brazed, etc). In other words, the reflective fins 27 protrude radially outwardly from the diffusion sheet 22. In this case, the reflective fins 27 are in thermal exchange contact with the diffusion sheet 22. Hence, when the fuel is being combusted in the burner 23, flames are outputted therefrom via the apertures 23A and heat the air in the combustion chamber 22A. This air then heats the diffusion sheet 22 by convection. The heat is therefore transmitted to the reflective fins 27 by conduction from the diffusion sheet 22. Heat may then be directed by radiation toward the users of the heater 10. The two reflective fins 27 may be axially offset from the burner 23 and may be located above the burner 23. Locations where the peripheral inner edges 27A of the reflective fins 27 are secured to the diffusion sheet 22 is selected to maximise convective and conductive heat transfer to the reflective fins 27.

In the depicted embodiment, the reflective fins 27 extend downwardly from the diffusion sheet 22 and toward the base 10. In other words, the peripheral inner and outer edges 27A, 27B may be axially offset from one another and the peripheral outer edges 27B may be located axially closer to the base 11 than the peripheral inner edges 27A relative to the central axis A. This configuration may contribute in reflecting the radiative heat toward the user of the heater 10. In the embodiment shown, the peripheral outer edge 27B of a top one of the two reflective fins 27 is axially offset from the peripheral inner edge 27A of a bottom one of the two reflective fins 27. This may allow the reflective fins 27 to redirect heat downwards and outwards. The reflective fins 27 may further retain and direct heat to limit heat from being wasted to the environment via the top.

In the present case, the outer edge 26A of the reflective shield 26 is located radially outwardly from the peripheral outer edges 27B of the reflective fins 27. Therefore, heat that moves upwardly by natural convection and that is not captured by the reflective fins 27 may be intercepted by the reflective shield 26 and reflected downwardly. Therefore, the disclosed heat generating device 20 including the reflective fins 27 and the reflective shield 26 may provide increased surface being heated by the combustion gases. Heat that is not captured by the reflective fins 27 may be captured by the reflective shield 26. In other words, the reflective fins 27 may help in retaining heat and redirecting the heat toward the user before the heat reaches the reflective shield 26. The reflective fins 27 may therefore minimize heat being wasted to the environment by convection between the reflective shield 26 and the environment.

Figure 4:
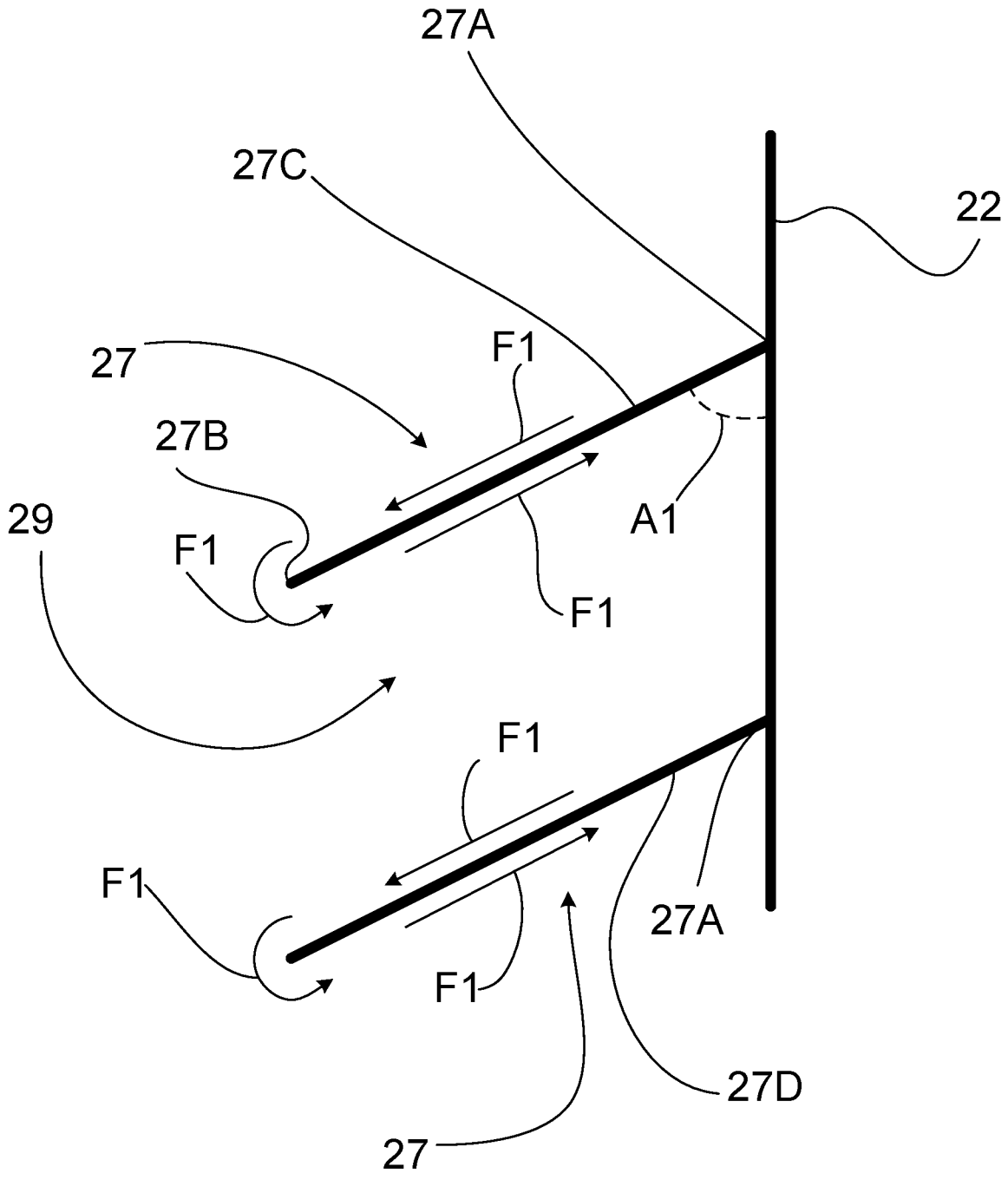
FIG. 4 is a cross-sectional view of a portion of the patio heater of FIG. 1.

Referring more particularly to FIG. 4, in the embodiment shown, an angle A1 between the reflective fins 27 and the perforated sheet 22 is about 30 to 40 degrees. Herein, the expression "about" may include variations by plus or minus 10%. The reflective fins 27 are hotter at their peripheral inner edges 27A than at their peripheral outer edges 27B because the peripheral inner edges 27A are closer to the combustion chamber 22A. This induces a convective air flow around the reflective fins 27. As illustrated, an air flow F1 flows adjacent upper surfaces 27C of the reflective fins 27 from the peripheral inner edges 27A toward the peripheral outer edges 27B. The air flow F1 wraps around the peripheral outer edges 27B and flows adjacent lower surfaces 27D of the reflective fins 27C toward the peripheral outer edges 27A.

The two reflective fins 27 may create a cavity 29, which may be substantially annular, located axially therebetween. Air located in this cavity 29 may be heated by conduction, radiation, and convection. The reflective fins 27 may become charged with heat from the combustion gases. This heat may then be radiated downwardly toward the user. The disclosed configuration may therefore provide a greater heat output toward the users of the heater 10 for the same flow of fuel being burned and compared to a configuration lacking the reflective fins 27. The disclosed heater 10 may increase efficiency and consume less fuel for the same amount of heat being directed by the users.

Figure 5:
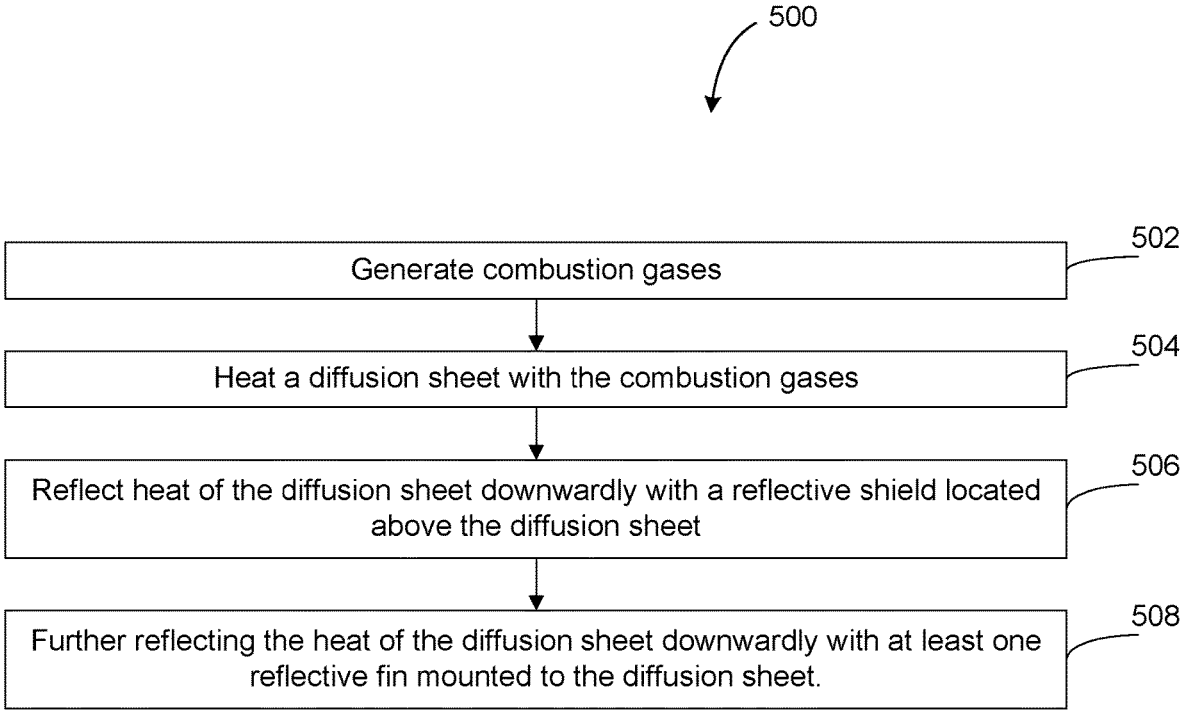
FIG. 5 is a flowchart illustrating steps of a method of operating the patio heater of FIG. 1.

Referring now to FIG. 5, a method of operating the patio heater 10 is shown at 500. The method includes generating combustion gases at 502; heating the diffusion sheet 22 with the combustion gases at 504; reflecting heat of the diffusion sheet 22 downwardly with the reflective shield 26 located above the diffusion sheet 22 at 506; and further reflecting the heat of the diffusion sheet 22 downwardly with the at least one reflective fin 27 mounted to the diffusion sheet 22 at 508.

In the embodiment shown, the heating of the diffusion sheet 22 at 504 includes impinging the combustion gases against the diffusion sheet 22. The impinging of the combustion gases against the diffusion sheet 22 may include directing the combustion gases through the apertures 23A defined through the wall 23B of the burner 23. The apertures 23A may have aperture axes 23C extending along a direction having a component in a radial direction relative to the central axis A.

In the disclosed embodiment, the further reflecting the heat of the diffusion sheet 22 downwardly with at least one reflective fin 27 mounted to the diffusion sheet 22 at 508 includes reflecting heat downwardly with two reflective fins 27 disposed above one another. The method may include heating a volume of air contained within the cavity 29 defined between the two reflective fins 27.

The reflecting of the heat with the reflective shield 26 at 506 may include reflecting the heat with the reflective shield 26 extending radially outwardly beyond outer edges of the diffusion sheet 22.

The method 500 may include conductively transferring heat from the diffusion sheet 22 to the at least one reflective fin 27.

As can be seen therefore, the examples described above and illustrated are intended to be exemplary only. The scope is indicated by the appended claims.

What is claimed is:

1. A patio heater, comprising:
- a base to be supported on a ground;
- a stem protruding upwardly away from the base; and
- a heat generating device secured to the stem, the heat generating device having:
  - a burner fluidly connected to a source of a fuel to be burned;
  - a diffusion sheet enclosing a combustion chamber, the burner located inside the combustion chamber and surrounded by the diffusion sheet;
  - a reflective shield located above the diffusion sheet; and
  - at least one reflective fin mounted to the diffusion sheet and extending away therefrom, an angle at which the at least one reflective fin intersects the diffuser sheet and being defined between the at least one reflective fin and the diffuser sheet ranges from 30 to 40 degrees.

2. The patio heater of claim 1, wherein the at least one reflective fin includes two reflective fins disposed above one another.

3. The patio heater of claim 2, wherein an annular cavity is defined axially between the two reflective fins and radially from the diffuser sheet towards outer edges of the two reflective fins.

4. The patio heater of claim 1, wherein each of the at least one reflective fin extends annularly all around the combustion chamber.

5. The patio heater of claim 1, wherein the at least one reflective fin has a peripheral inner edge and a peripheral outer edge located radially outwardly from the peripheral inner edge relative to a central axis of the heater, the peripheral inner edge being in thermal exchange contact with the diffusion sheet.

6. The patio heater of claim 1, wherein the burner is annular.

7. The patio heater of claim 6, wherein the burner defines apertures circumferentially distributed about a central axis of the patio heater, the apertures extending through a wall of the burner about aperture axes, the aperture axes extending along a direction having a component in a radial direction relative to the central axis.

8. The patio heater of claim 1, wherein each of the at least one reflective fin is located above the burner.

9. The patio heater of claim 1, wherein the reflective shield extends radially beyond a peripheral outer edge of the at least one reflective fin.

10. The patio heater of claim 1, wherein the at least one reflective fin extends downwardly toward the base.

11. The patio heater of claim 1, wherein the reflective shield is made of a material including aluminum.

12. The patio heater of claim 1, wherein the at least one reflective fin is made of a material including stainless steel.

13. A method of operating a patio heater, comprising:

generating combustion gases;

heating a diffusion sheet with the combustion gases;

reflecting heat of the diffusion sheet downwardly with a reflective shield located above the diffusion sheet; and further reflecting the heat of the diffusion sheet downwardly with at least one reflective fin mounted to the diffusion sheet, including reflecting the heat with the at least one reflective fin intersecting the diffuser sheet at angle ranging from 30 to 40 degrees.

14. The method of claim 13, wherein the heating of the diffusion sheet with the combustion gases includes impinging the combustion gases against the diffusion sheet.

15. The method of claim 14, wherein the impinging of the combustion gases against the diffusion sheet includes directing the combustion gases through apertures defined through a wall of a burner, the apertures having aperture axes extending along a direction having a component in a radial direction relative to a central axis of the patio heater.

16. The method of claim 13, wherein the further reflecting the heat of the diffusion sheet downwardly with at least one reflective fin mounted to the diffusion sheet includes reflecting heat downwardly with two reflective fins disposed above one another.

17. The method of claim 16, comprising heating a volume of air contained within a cavity defined between the two reflective fins.

18. The method of claim 13, wherein the reflecting of the heat with the reflective shield includes reflecting the heat with the reflective shield extending radially outwardly beyond outer edges of the diffusion sheet.

19. The method of claim 13, comprising conductively transferring heat from the diffusion sheet to the at least one reflective fin.

* * * * *